US006640896B1

(12) United States Patent
Zheng

(10) Patent No.: US 6,640,896 B1
(45) Date of Patent: Nov. 4, 2003

(54) MECHANICAL OIL RECOVERY METHOD AND SYSTEM WITH A SUCKER ROD PUMP

(75) Inventor: Haijin Zheng, Jiangdu (CN)

(73) Assignees: China Petroleum & Chemical Corporation, Beijing (CN); Jiangsu Oil Field Branch of China Petroleum & Chemical Corporation, Yangzhou (CN)

( * ) Notice: Subject to any disclaimer, the term of this patent is extended or adjusted under 35 U.S.C. 154(b) by 0 days.

(21) Appl. No.: 10/031,754

(22) PCT Filed: Jul. 14, 2000

(86) PCT No.: PCT/CN00/00202

§ 371 (c)(1),
(2), (4) Date: May 9, 2002

(87) PCT Pub. No.: WO01/06125

PCT Pub. Date: Jan. 25, 2001

(30) Foreign Application Priority Data

Jul. 15, 1999 (CN) ..... 99109780 A

(51) Int. Cl.[7] ..... E21B 43/00

(52) U.S. Cl. ..... 166/250.15; 166/66; 166/53; 166/64; 166/68; 166/72; 166/373; 417/44.11; 73/112; 73/152.62

(58) Field of Search ..... 166/66, 53, 64, 166/263, 68, 72, 250.15, 367, 373; 137/624.2; 417/44.1, 44.11; 73/112, 152.62

(56) References Cited

U.S. PATENT DOCUMENTS

| | | | | |
|---|---|---|---|---|
| 3,930,752 A | | 1/1976 | Douglas | 417/12 |
| 4,460,038 A | | 7/1984 | Clamens | 166/66 |
| 4,486,249 A | * | 12/1984 | Woodings | |
| 4,633,954 A | | 1/1987 | Dixon et al. | 166/372 |
| 4,727,489 A | * | 2/1988 | Frazier et al. | |

FOREIGN PATENT DOCUMENTS

| | | | | |
|---|---|---|---|---|
| CN | 1048076 A | 12/1990 | ..... | E21B/21/08 |
| CN | 1102458 A | 5/1995 | ..... | F04B/47/04 |
| CN | 1117555 A | 2/1996 | ..... | E21B/43/00 |
| CN | 2252331 Y | 4/1997 | ..... | G01F/1/56 |
| CN | 2312324 Y | 3/1999 | ..... | E21B/43/27 |
| EP | 0 881 357 A2 | 12/1998 | ..... | E21B/44/00 |
| RU | 2016252 C1 | 7/1994 | ..... | F04D/15/00 |
| RU | 2068492 C1 | 10/1996 | ..... | E21B/43/00 |
| RU | 2101469 C1 | 1/1998 | ..... | E21B/43/00 |
| RU | 2116435 C1 | 7/1998 | ..... | E21B/43/00 |
| RU | 2125151 C1 | 1/1999 | ..... | E21B/43/00 |
| SU | 1102901 A | 7/1984 | ..... | E21B/43/00 |
| SU | 1177458 A | 9/1985 | ..... | E21B/43/00 |

* cited by examiner

*Primary Examiner*—Roger Schoeppel
(74) *Attorney, Agent, or Firm*—Pennie & Edmonds LLP

(57) ABSTRACT

This invention relates to a mechanical oil recovery method and system with a sucker-rod pump. The method calculates the lowest power loss or the lowest cost. The method comprises sequentially arranging internal diameter, steel grade of rod, pump diameter, pumping depth and stroke amplitude, searching the combinations of rods to calculate pump efficiency and the number of strokes, on the basis of $P_{input}=P_{active}-P_{expansion}+P_{loss}$, and calculating, corresponding to the input power $P_{input}$, active power $P_{active}$, expansion power $P_{peng}$, ground power loss $P_d$, sliding power loss Ph and viscose power loss $P_v$ and the sum of losses $P_{loss}$. The mechanical oil-recovering cost is then calculated for each combination, and each mechanical oil-recovering parameter is chosen.

18 Claims, 1 Drawing Sheet

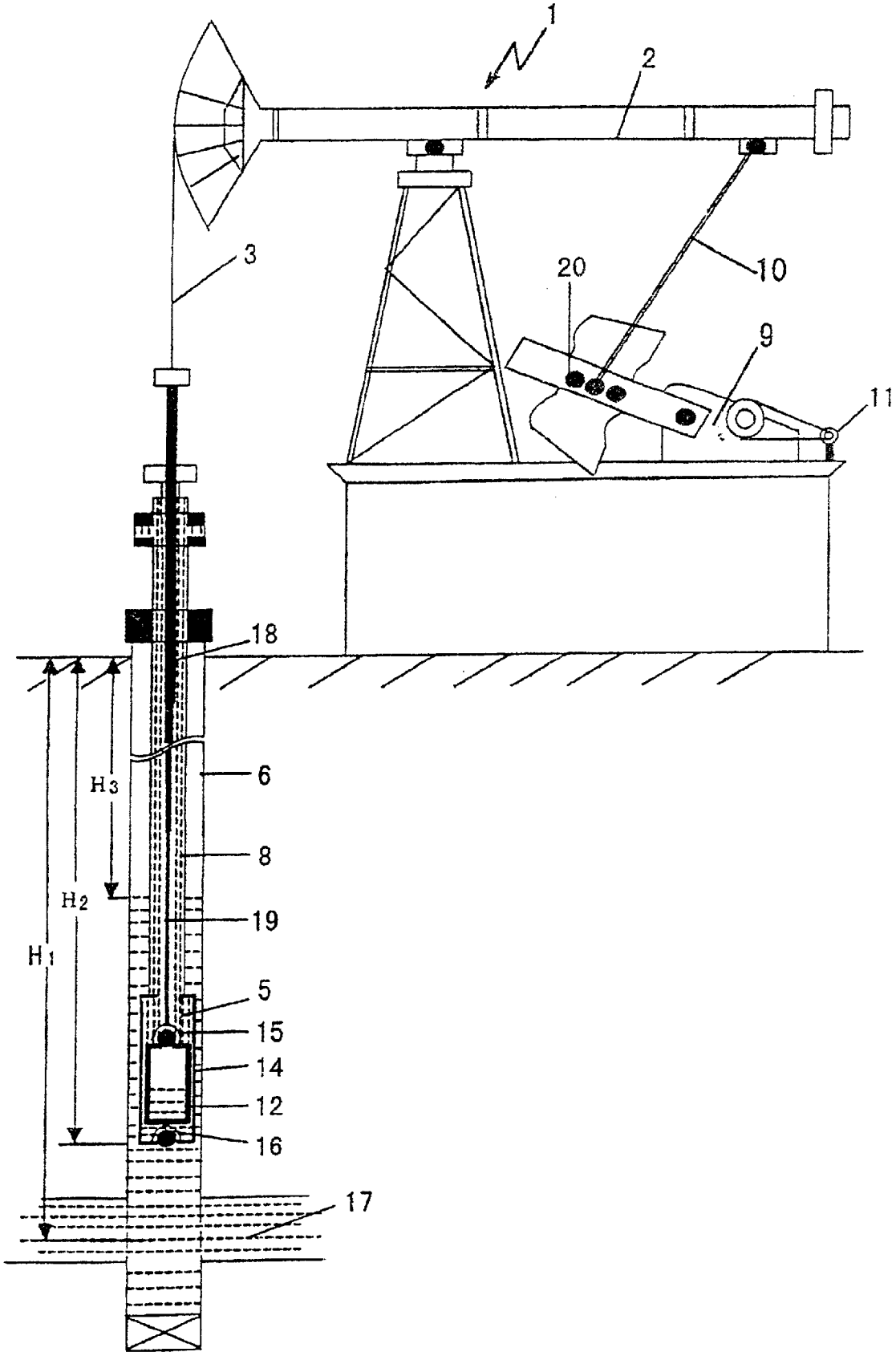
1
2
3
20
10
9
11
18
6
8
19
5
15
14
12
16
17
H3
H2
H1

MECHANICAL OIL RECOVERY METHOD AND SYSTEM WITH A SUCKER ROD PUMP

TECHNICAL FIELD

This invention relates to the technical field of oil production, more specifically, to a method and a machinery system of mechanical oil production with a sucker-rod pump.

BACKGROUND OF THE INVENTION

During production of oil well with a rod pump, the expense of energy consumption forms a large part of the variable cost with the price of electricity increasing, its proportion has been more than 12%. The average efficiency of machinery system of oil production is an important index, which represents the level of mechanical oil production, and in "Eighth five year plan" period of our country the average efficiency was 24%. This means a large amount of energy wasted in lifting process. If the efficiency of the machinery system of oil production is increased from 20.4% to 30%, 16 million yuan electrical expense could be saved every year only in a small oil field of Jiangsu province in China, while the service lives of beam units, rods, pumps, and tubes could be prolonged, and the period of well without maintenance and the period of wax removal and inhabitation could be prolonged, then technology guarantee could be provided for reasonable development of oil reservoir. As a result the technology to raise the efficiency of machinery system of oil production has a prospect of wide applications. In the end of 1960's in U.S. a lot of research works were done to this subject, and in 1984 the research achievements had been applied to 1065 wells in California so that the average efficiency of machinery system of oil production had reached 29.4%. In our country in the beginning of 1980' Daqing oil field began to carry out the research about this problem, and the achievements had been applied to 69 wells in Daqing oil field so that the average efficiency of the machinery system of oil production had reached 28.7%.

In recent years since the research works are continuously deepened and the management is further detailed, the efficiency of machinery of oil production is continuously raised, but these jobs are mainly focused on innovating of the mechanism and lifting efficiency of the pump. An oil production is determined mainly according to API standard and "Principle of oil production technology" as a criterion, but these criterions have some weaknesses since they do not mean at minimum of the energy consumption, also do not mean at minimum of mechanism wearing, and only they meet need of the output and requirements of the strength as basic points.

For example the principle of selecting the pump according to "Principle of oil production technology" is that, under the condition of meeting the requirement of daily output the pump diameter is selected as smaller as possible based on the selected beam pumping unit, daily liquid output, and pump setting depth, without considering the influences of physical properties of crude oil and borehole deviation. The principle of selecting the pump based on API standard is that, in various pump diameters, the selected pump diameter is what makes the polished rod power minimum when lifting pure water, without considering the influences of physical properties of crude oil and borehole deviation; also in regard to the principle of determining submergence depth, i.e. when gas oil ratio is less than 80 $m^3/m^3$, submergence depth is requested at a range of 50 m–200 m. In fact, if the submergence depth is determined according to this request, the efficiency of pump is generally low. The all principles mentioned above could not make a comparison between economic benefits corresponding to using different tube diameters, different steel rod grades, and also could not determine the mechanical oil production cost corresponding to different parameters combinations of machinery system of oil production. The main reason is that, there are no theoretical formula of calculating input power of the machinery system for various dynamic and static parameters in a well producing with a sucker rod, and there is not scientific and reasonable method to select the way of oil production.

Different combinations of production parameters can be used for producing the same daily output in one particular well, however the costs for different parameter combinations are different. Because there is no theoretical formula showing the function relationship between the input power of machinery system of oil production with a rod pump and oil well dynamic and static parameters, when the parameters of the machinery system of oil production are designed for an oil well in which a sucker-rod pump is used, neither oil tube diameter nor steel rod grade can be determined; and no energy consuming and mechanical wearing corresponding to different parameter combinations can be predicted either. It is difficult to define the optimal parameter combination such as tube diameter, steel rod grades, pump diameter, pump setting, rod diameter, stroke, and pumping speed. Not only dependent on liquid production, water cut, gas oil ratio(GOR), and dynamic fluid level, since other physical properties of crude oil, physical properties of oil layer, and borehole deviation of different oil reservoirs, different oil layers, and different oil wells are individually different, these factors will in more or less influence energy consuming and machinery wearing of machinery system of oil production either. Therefore, although well A and B have the same daily liquid production, dynamic fluid level, water cut, and gas oil ratio, there is still a possibility that the efficiency in well A is high but in well B can be very low by using the same parameter combination. As a result there exists neither a mature technology with broad adaptability, nor such oil production method and system with principles of minimum power consumption or optimal comprehensive economic benefits for the same daily liquid production.

Therefore, the object of the present invention is to overcome the shortcoming of the prior art, and to provide a method and a machinery system of oil production with a sucker-rod pump which makes various power losses in oil production significantly reduced and the oil production cost decreased.

SUMMARY OF THE INVENTION the present invention provides a method of oil production with a sucker-rod pump, comprising:

(a) predicting the objective daily liquid production, water cut, and dynamic fluid level of an oil well;

(b) measuring the viscosity of degasified crude oil on the ground and wax precipitation temperature of crude oil;

(c) acquiring physical parameters of the crude oil of the oil well in formation conditions and the parameters of borehole deviation;

(d) measuring the temperature in the middle of the oil zone and the temperature on the surface of the earth;

(e) selecting the type of beam unit;

(f) preliminary determining all ranges of tube diameters, diameters of deep well pump, setting depths of pump, material types of sucker-rod and rod string , strokes of the selected beam unit, pumping speeds of the beam unit;

(g) finding out all of combinations of different pump diameters, pump setting depths, tube diameters, rod material types, rod strings, strokes, and pumping speeds, which can achieve the same daily liquid production in the well, then calculating out input power $P_{input}$ of respectively corresponding to each parameter combination according to following formula:

$$P_{input}=P_{active}-P_{expansion}+\Sigma P_{loss}$$

where:

$P_{active}$ is active power (W);

$P_{expansion}$ is expansion power (W) caused by crude oil degasifying in tube above the pump standing valve;

$\Sigma P_{loss}$ is total loss power;

(h) taking the combination of parameters corresponding to minimum $P_{input}$ as the system parameters of mechanical oil production, or taking the one corresponding to minimum cost of mechanical oil production as the system parameters of mechanical oil production;

(i) deciding oil tube material type and length based on tube diameter and pump depth, deciding the specification of the deep well pump by pump diameter and maximum stroke of the beam pumping unit, and deciding specification and length of required each type of the sucker-rod by material type and rod string;

(j) deciding the type of the motor coupled with the beam pumping unit by defined pumping speed and system input power so that the oil production system can be established by the special beam pumping unit, the motor, the oil tubes, the sucker-rods, and the deep well pump.

Abovementioned physical parameters of formation crude oil in an oil well include gas oil ratio, saturation pressure, solution coefficient, formation crude oil viscosity, and formation crude oil density.

In order to decide the range of pump setting depth following method can be used: when fluid pressure is larger than or equal to saturation pressure, the pump setting begins from dynamic fluid level, then based on interval step length, sequencing depth is in turn deepened until pump intake pressure is equal to saturation pressure; when fluid pressure is lower than saturation pressure, the pump setting begins from dynamic fluid level, then based on interval step length, sequencing depth is in turn deepened until to top of an oil layer.

The present invention also provides a system of mechanical oil production with a sucker-rod pump, which includes a beam pumping unit, a motor, an oil pumping tube, a kind of sucker-rod combination and a deep well pump; said motor being fitted on the beam pumping unit and driving the latter, the sucker-rod being positioned in said oil pumping tube, said beam pumping unit being connected with the sucker-rod by a jointer, and the sucker-rod being conjoined with the plunger of the deep well pump submerged under the liquid level, the operating cylinder of the deep well pump being connected with said oil pumping tube; wherein structure parameters of individual components in the system are selected as follows: (a) selecting the type of the beam pumping unit based on objective daily liquid production, water content ratio, and dynamic fluid level of the oil well; (b) preliminary determining all ranges of tube diameters, tube length, diameters of the deep well pump, setting depths of the deep well pump, material types of the sucker-rod, rod string, strokes of selected beam unit, and pumping speeds of the beam pumping unit; (c) finding out all of combinations of different pump diameters, pump depths, tube diameters, rod material types, rod string, strokes, and pumping speeds, then calculating out input power $P_{input}$ respectively corresponding to each parameter combination according to the formula listed below:

$$P_{input}=P_{active}-P_{expansion}+\Sigma P_{loss}$$

where:

$P_{active}$ is active power (W);

$P_{expansion}$ is expansion power (W) caused by crude oil degasifying in oil tube above the pump standing valve;

$P_{loss}$ is total loss power (d) deciding oil tube specification and length based on tube diameter and pump depth, deciding the specification of the deep well pump based on pump diameter and maximum stroke of the beam pumping unit, and deciding specification and length of required each type of the sucker-rod based on material type and rod string;

(e) taking the parameter combination corresponding to minimum $P_{input}$ as the parameters of the machinery of system oil production, or taking the one corresponding to minimum cost of mechanical oil production as the parameters of the machinery system of oil production to be defined;

(f) deciding the type of the motor coupled with the beam pumping unit by defined pumping speed and system input power so that the oil production system can be established by the special beam pumping unit, the motor, the oil tubes, the sucker-rods, the deep well pump.

The system and the method of present invention will be described in detail below with the reference of the accompanying drawing which is schematic view of a machinery system of oil production with a sucker-rod pump.

DETAILED DESCRIPTION OF THE INVENTION

As shown in the drawing, the system of mechanical oil production with a sucker-rod pump generally is indicated by numeral 1, including a beam pumping unit 2, a motor 11, an oil pumping tube 8, a sucker-rod 18, and a deep well pump 5. The motor is fitted on the beam pumping unit 2 and driving the latter by a reducer gear 9 and a four bar linkage 10. The stroke of the beam pumping unit 2 is determined by the coupling between the four bar linkage 10 and stroke hole 20. The sucker-rod is positioned in said oil pumping tube 8. The beam pumping unit 2 is connected with the first stage sucker-rod by the jointer 3. And the last stage sucker-rod 19 is connected with the plunger 12 of the deep well pump 5 submerged under the liquid level in the sleeve 6 at the area of traveling vale 15. As shown in the drawing, where the dash line stands for liquid, $H_1$ indicates the distance form ground to middle of an oil layer, $H_2$ indicates the pump setting depth, $H_3$ indicates the depth of dynamic fluid level, numeral 17 stands for an oil layer. The operating cylinder 14 of the deep well pump is connected with said oil pumping tube 8, and one standing vale 16 is provided at the bottom of operating cylinder 14. Wherein the structure parameters of various components in the system can selected as follows: (a) selecting the type of the beam pumping unit 2 based on objective liquid production, water content ratio, and dynamic fluid level of the oil well; (b) preliminary determining all ranges of tube diameters, tube lengths, diameters of the deep well pump 5, setting depth of the deep well pump, material types of the sucker-rod 7, strings, strokes of the selected beam unit, and pumping speeds of the beam unit; (c)finding out all of combinations of different pump diameters, pump depths, tube diameters, rod material types, strings, strokes, and pumping speeds, which can achieve the same objective daily liquid production, then calculating out input power $P_{input}$ respectively corresponding to each parameter combination according to the formula listed below:

$$P_{input}=P_{active}-P_{expansion}+\Sigma P_{loss}$$

where:

$P_{active}$ is active power (W);

$P_{expansion}$ is expansion power (W) caused by crude oil degasifying in oil tube above the pump standing valve;

$P_{loss}$ is total loss power (d) taking the combination of parameters corresponding to minimum $P_{input}$ as the system parameters of machinery system of oil production, or taking the one corresponding to minimum cost of mechanical oil production as the parameters of machinery oil production;

(e) deciding oil tube material type and length by tube diameter and pump depth, deciding the specification of the deep well pump based on pump diameter and maximum stroke of the beam pumping unit, and deciding specification and length of required each type of the sucker-rod based on material type and rod string;

(f) deciding the type of the motor coupled with the beam pumping unit by defined pumping speed and system input power so that the oil production system can be established by the special beam pumping unit, the motor, the oil tubes, the sucker-rod, and the deep well pump.

The steps of determining total loss power $\Sigma P_{loss}$ are as follows:

$$\Sigma P_{loss}=P_u+P_r+P_k$$

where:

$P_u$ is loss power(W) of the ground beam unit and the motor;

$P_r$ is viscous loss power(W) caused by friction occurred among oil tube liquid positioned above the pump cylinder and the oil tube , the sucker-rod;

$P_k$ is sliding loss power(W) caused by friction occurred between the sucker-rod and the oil tube and caused by friction occurred between the piston and the pump cylinder during the sucker-rod is reciprocated.

The steps of determining the expansion power $P_{expansion}$ are as follows:

A: when $P_{sub} \geqq P_b$ and $P_{wellhead} < P_b$ $$P_{expansion} = \frac{10^5 \alpha Q_{oil} P_b}{86400} \ln \frac{10P_b + 1}{10P_{wellhead} + 1}$$

B: when $P_{sub} \geqq P_b$ and $P_{wellhead} \geqq P_b$ $P_{expansion}=0$

C: when $P_{sub} < P_b$ and $P_{sub} > P_{wellhead}$ $$P_{expansion}=10^5 \alpha Q_{oil} P_{sub}/86400 \ln 10P_{sub}+1/10P_{wellhead}+1$$

D: when $P_{sub} < P_b$ and $P_{wellhead} > P_{sub}$ $P_{expansion}=0$ where:

$P_{expansion}$: expansion power (W)

$P_{sub}$: pump intake pressure (Mpa)

$P_b$: crude oil saturation pressure (Mpa)

$P_{wellhead}$: wellhead oil pressure (Mpa)

$\alpha$: solution coefficient ($m^3/m^3$ Mpa)

$Q_{oil}$: daily crude oil output ($m^3/d$).

The ground loss power $P_u$ is decided by following equation:

$$P_u=P_d+k_2(F_{up}+F_{down})\cdot s\cdot n+k_2(F_{up}-F_{down})\cdot s\cdot n$$

where:

$P_d$: motor power (w) without load $F_{up}$: average load of polished rod in up stroke (N)

$F_{down}$: average load of polished rod in down stroke (N)

$k_1$: influence coefficient of polished rod transmission power on $P_u$ $k_2$: influence coefficient of polished rod power on $P_u$ s: stroke (m/each time)

n: pumping speed (times/s)

The sliding loss power $P_k$ is as follows:

$$P_k=2f_k \cdot q_{rod} \cdot L_{level} \cdot s \cdot n$$

where:

$f_k$: sliding friction coefficient between the rod and the tube, $$f_k=0.05 \approx 0.18$$

$q_{rod}$: average unit length weight of the rod in the inclination section (N/M)

$L_{level}$: horizontal projection track length of the rod of inclination section (m)

The viscous loss power $P_r$ is decided according to following equation:

$$P_r=k_3\pi^3 s^2 n^2\{(m^2-1)/[(m^2+1)\ln m-(m^2-1)]\}\Sigma\mu_i L_i$$

$$\Sigma\mu_i L_i=k_4\mu_o(T_{layer}-T_{wax})+k_5\mu_o Q_{oil}(T_{wax}-T_{wellhead})+k_6\mu_o(-f_w^2+1.2f_w)+C$$

$$T_{wellhead}=k_7 Q_1(T_{layer}-T_{ground})+k_2 Q_1 H_{dyn}+k_3 P_{expansion}+C_2$$

$$Q_1=Q+(C_w/C_o-1)QF_w$$

where:

$T_{wellhead}$: wellhead oil temperature in crude oil lifting process (°C.)

$T_{layer}$: reservoir temperature (°C.)

$T_{wax}$: crude oil wax precipitation temperature (°C.)

$Q_{oil}$: oil well daily crude oil output ($m^3/d$)

Q: daily liquid production ($m^3/d$)

$\mu_o$: degasified crude oil viscosity (mpa. s)

$\mu_i$: crude oil viscosity at ith segment of the oil tube in crude oil lifting process (mpa. s)

$L_i$: ith segment oil tube length m: the ratio of oil tube inside diameter to sucker-rod diameter $k_3$: sucker-rod collar coefficient $k_4, k_5, k_6$: measured coefficients C, $C_2$: measured constants $C_w$: water specific heat (J/Kg)

$C_o$: oil specific heat (J/Kg)

Base on following equation the total loss power $\Sigma P_{loss}$ is calculated:

$$\Sigma P_{loss}=P_d+[(F_{up}+F_{down})k_1+(F_{up}-F_{down})k_2]sn+k_3\pi^3 s^2 n^2\{(m^2-1)/[(m^2+1)\ln m-(m^2-1)]\}*\Sigma\mu_i L_i+2f_k q_{rod} L_{level} sn$$

If the calculation formula of oil production technology principle $$Q = \frac{1}{4}\pi D_{pump}^2 sn\eta 86400$$

is substituted into above equation, then total loss power $\Sigma P_{loss}$ can be further calculated by following equation:

$$\Sigma P_{loss}=P_d+[(F_{up}+F_{down})k_1+(F_{up}-F_{down})k_2]$$

$$4Q/\pi\rho D_{pump}^2\eta 86400$$

$$+k_3 24\pi\{(m^2-1)/[(m^2+1)\ln m-(m^2-1)]\}*\Sigma(\mu_i L$$

$$i)*Q^2/\rho^2 D_{pump}^4\eta^2 86400^2$$

$$+8f_k q_{rod} L_{level} Q/\pi\rho D_{pump}^2\eta 86400$$

where:

$D_{pump}$: deep well pump plunger diameter (mm)

η: pump efficiency.

Individual parameters of mechanical oil production of each combination and corresponding effect parameters of the present invention are: tube diameter, steel rod grades, pump diameter, pump setting depth, stroke, pumping speed, pump efficiency, active power, input power, system efficiency, and annual cost.

The cost of annual mechanical oil production includes: electrical expense of relevant year, the value of mechanical wearing of the relevant year being calculated based on the prices of the oil tube, the sucker-rod, and the pump; and annual interest of all initial investment.

The effects of the present invention are as follows: the shortcomings existed in API standard and "Principle of oil production technology" criterion have been overcome, and oil production depend on the principles of minimum energy consumption and/or minimum cost has been realized. Since the main factors influenced efficiency of the machinery system of oil production are found out through research and the influences of crude oil physical properties and hole deviation are considered, it is possible to make a comparison among the economic benefits corresponding to using different tube diameters and different steel rod grades, and to determine the costs of mechanical oil production corresponding to different parameter combinations of mechanical oil production so that the oil production system can be scientifically and reasonably defined. The efficiency of mechanical oil production system will be raised greatly by way of the present invention, generally reached 40–65%, and the period without well maintenance will be prolonged significantly.

The comparison effects of the present invention will be obvious via following measured data of three oil wells:

The table 1 is parameters of an example;

The table 2 is the comparison table by respectively using the present invention and the principle of oil production technology and API methods in the well A; wherein GLZD stands for the method of the present invention.

The table 3 is the error table between measured values and calculated results of the present invention in the well A;

The table 4 is the comparison table among the present invention and the principle of oil production technology and API methods in the well B;

The table 5 is the error table between measured values and calculated results of the present invention in the well b;

The table 6 is the comparison table among the present invention and the principle of oil production technology and API methods in the well C;

The table 7 is the error table between measured values and calculated results of the present invention in the well C;

An example of the present invention is described as follows: The basic data of the oil well of the example are listed as below:

| | |
|---|---|
| daily liquid production (t/d): | 19.6 |
| dynamic fluid level (m): | 871.20 |
| kick off point (m): | 650.00 |
| motor model: | CJT-10a |
| type of beam pumping unit: | CYJ8 |
| crude oil saturation pressure (Mpa): | 3.82 |
| casinghead pressure (Mpa): | 0.00 |
| reservoir temperature (° C.): | 68.00 |
| crude oil wax precipitation temperature (° C.): | 40.00 |
| crude oil solidifying point (° C.): | 35.00 |
| 50° C. degasified crude oil viscosity (cp): | 27.70 |
| formation crude oil viscosity (cp): | 9.39 |
| gas oil ratio: | 19.00 |
| crude oil density (g/cm$^3$): | 0.8600 |
| motor power without load (kW): | 1.00 |
| combination of stroke (m): | 3/2.40/1.80 |
| oil layer middle depth (m): | 1504.10 |
| oil wellhead pressure (Mpa): | 0.80 |
| solution coefficient (m$^3$/m$^3$ · Mpa): | 4.2450 |
| water content ratio (%): | 0.00 |

Then the parameters of different combinations are worked out by looking up the related tables.

Then tube diameter (which can be preselected), rod material type, and pump diameter are defined, and pump setting depth is selected based on 1 m~100 m step length in turn increasing the depth (in this embodiment of the present invention step length is 30 m). When fluid pressure is larger than or equal to saturation pressure, the pump setting begins from dynamic fluid level, then the depth is increased in sequence until fluid pressure is equal to saturation pressure. When fluid pressure is lower than saturation pressure, the pump setting begins from dynamic fluid level, then the depth is increased in sequence until to top of an oil layer. After pump setting depth has been selected, then stroke, pumping speed, rod string, and pump efficiency are reckoned.

Next the data found-out and calculated are one by one arranged in combinations, i.e. at first tube diameters are arranged in sequential series based on inside diameters. If tube diameter is equal, steel rod grades are arranged in sequential series based on magnitude of strength. If steel rod grades are the same, pump diameters are arranged in sequential series based on size, and so on and so forth, depend on magnitude of pump setting depth. Different strokes are arranged in sequential series based on length, then above parameters are combined one after another. Finally the rod string, pump efficiency, and pumping speed of various parameter combinations are found out.

In the light of oil well basic data and above-mentioned various combination data, and based on $P_{input}=P_{active}-P_{expansion}+\Sigma P_{loss}$, the input power Pinput corresponding to each parameter combination of mechanical oil production is calculated, wherein $P_{active}$ is active power (W), equal to secondly liquid production×effective lifting height, $P_{expansion}$ is expansion power (W) caused by crude oil degasifying in oil tube above the pump standing valve, the steps of determining the expansion power $P_{expansion}$ are as follows:

A: when $P_{sub} \geqq P_b$ and $P_{wellhead} < P_b$ $$P_{expansion} = \frac{10^5 \alpha Q_{oil} P_b}{86400} \ln \frac{10P_b + 1}{10P_{wellhead} + 1}$$

B: when $P_{sub} \geqq P_b$ and $P_{wellhead} \geqq P_b$ $P_{expansion}=0$

C: when $P_{sub}<P_b$ and $P_{sub}>P_{wellhead}$ $$P_{expansion} = \frac{10^5 \alpha Q_{oil} P_{sub}}{86400} \ln \frac{10P_{sub}+1}{10P_{wellhead}+1}$$

D: when $P_{sub}<P_b$ and $P_{wellhead}>P_{sub}$ $P_{expansion}=0$ where:

$P_{expansion}$: expansion power (W)

$P_{sub}$: pump intake pressure (Mpa)

$P_b$: crude oil saturation pressure (Mpa)

$P_{wellhead}$: wellhead oil pressure (Mpa)

$\alpha$: solution coefficient ($m^3/m^3$Mpa)

$Q_{oil}$: daily crude oil output ($m^3$/d).

$\Sigma P_{loss}$ is total loss power, and equal to $\Sigma P_{loss}=P_u+P_r+P_k$, $P_u$ is loss power of the ground beam pumping unit and the motor(W); $P_k$ is sliding loss power caused by friction occurred between the sucker-rod and the oil tube during the sucker-rod is reciprocated(W). Pr is viscous loss power (W) caused by friction occurred between liquid in oil tube above the pump cylinder and the oil tube as well as between the liquid and the sucker-rod.

They can be decided by following formulas:

The loss power of ground $P_u$:

$$P_u=P_d+(F_{up}+F_{down})snk_1+k_2(F_{up}-F_{down})snk_2$$

where:

$P_d$: motor power (w) without load $F_{up}$: up stroke, average load of polished rod (N)

$F_{down}$: average load of polished rod (N) during down stroke s: stroke (m/each time)

n: pumping speed (times/s)

$k_1$: measured structure coefficient of the beam pumping unit, e.g. being taken as 0.03

$k_2$: measured driving coefficient of the motor to the belt, e.g. being taken as 0.15.

The sliding loss power $P_k$:

$$P_k=2f_k q_{rod} L_{level} sn$$

where:

$f_k$: sliding friction coefficient between the rod and the tube, e.g. being taken as 0.1

$q_{rod}$: average unit length weight of the rod in inclination section (N/m)

$L_{level}$: horizontal projection track length of the rod of inclination section (m).

The viscous loss power:

$$P_r = k_3\pi^3 s^2 n^2 \frac{m^2-1}{(m^2+1)\ln m-(m^2-1)} \Sigma\mu_i L_i$$

$$\Sigma\mu_i L_i = k_4\mu_o(T_{layer}-T_{wax}) + k_5\mu_o Q_{oil}(T_{wax}-T_{wellhead}) + k_6\mu_o(-f_w^2+1.2f_w) + C$$

where:

$T_{wellhead}$: wellhead oil temperature in crude oil lifting process (°C.)

$T_{layer}$: reservoir temperature (°C.)

$T_{wax}$: crude oil wax precipitation temperature (°C.)

$Q_{oil}$: oil well daily crude oil output ($m^3$/d)

$\mu_o$: crude oil viscosity (mpa. s)

$\mu_i$: crude oil viscosity at ith segment of the oil tube in crude oil lifting process (mpa. s)

$L_i$: ith segment oil tube length m: the ratio of oil tube inside diameter to sucker-rod diameter $k_3$: sucker-rod collar coefficient $k_4$,$k_5$,$k_6$: measured coefficient $C_,$: measured constant It can be obviously seen through calculation and all combinations of the present embodiment that various tube diameters, various steel rod grades, various pump diameters and various pump settings (corresponding to rational rod combinations), various strokes, and various pumping speeds are combined one by one, then each combination leads to one efficiency of machinery system of oil production, i.e. corresponds to one of energy consumption and one of input investment and wearing of the tubes, the rods, and the pumps. The input powers corresponding to each parameter combination of mechanical oil production are calculated respectively by the formulas, also relevant costs of mechanical oil production too. The cost of annual mechanical oil production can include: relevant annual electrical expense, the relevant annual mechanical wearing and maintenance expenses based on the prices of the oil tube, the sucker-rod, and the pump, as well as investment interests etc. Individual parameters of mechanical oil production of each combination, such as tube diameters, steel rod grades, pump diameters, pump setting depths, strokes, pumping speeds, pump efficiencies, active powers, input powers, system efficiencies, and annual costs etc. are listed in the tables, then the combination in the table with minimum cost is directly selected as the parameters of mechanical oil production, i.e. the combination with minimum cost is obtained. By the same token, the tube diameter, tube length, steel rod grades, pump diameter, pump setting depth, rod string, stroke, and pumping speed of corresponded combination also can be selected based on minimum input power.

The calculating results of the present invention embodiment are listed in the Table 1, therefore from the column of "input power" or "annual cost" in the Table the minimum value can be directly selected, the individual parameters in the relevant row corresponding to the minimum value are the design parameters of mechanical oil production of the well. In the present embodiment, selected parameters are as follows: beam pumping unit model: CYJ8-3-37HB, motor type: 12 pole 15 Kw, oil tube inside diameter: 62 mm, sucker-rod steel grade: E, pump diameter: 56 mm, pump setting: 1321 m, stroke: 3 m, pumping speed: 3 times/minute, rod combination: ⅝ inch×1321 m.

For the sake of convenience, the total loss power $\Sigma P_{loss}$ of the present invention also can be calculated base on following equation:

$$\Sigma P_{loss} = P_d + [(F_{up}+F_{down})k_1 + (F_{up}-F_{down})k_2]\, sn + k_3\pi^3\Sigma\mu_i L_i \frac{m^2-1}{(m^2+1)\ln m-(m^2-1)} s^2 n^2 + 2f_k q_{rod} L_{level} sn$$

If the calculation formula of oil production technology principle $$Q = \frac{1}{4}\pi D_{pump}^2 sn\,\eta 86400$$

is substituted into above equation, then total loss power $\Sigma P_{loss}$ also can be calculated by following equation:

$$\Sigma P_{loss} = P_d + [(F_{up} + F_{down})k_1 + (F_{up} - F_{down})k_2]$$

$$\frac{4Q}{\pi\rho D_{pump}^2\eta 86400} +$$

$$k_3 24\pi\Sigma(\mu_i L_i)\frac{m^2 - 1}{(m^2 + 1)\ln m - (m^2 - 1)} \cdot$$

$$\frac{Q^2}{\rho^2 D_{pump}^4\eta^2 86400^2} + \frac{8 f_k q_{rod} L_{level} Q}{\pi\rho D_{pump}^2\eta 86400}$$

where:

$D_{pump}$: pump plunger diameter (mm) in deep well

η: pump efficiency.

Obviously, some of the modifications and variations of the present invention are easy to do for those skilled in the art. Therefore it is intended that these modifications and variations are also within the scope of the present invention which is stated in the accompanying claims.

The Calculating Results of the Examples

TABLE 1

| Oil tube diameter (mm) | rod diameter | pump diameter (mm) | pump setting depth (m) | Stroke (m) | pumping speed (times/s) | pump efficiency | active power (kW) | input power (kW) | system efficiency | annual cost (RMB) | 25 mm rod | 22 gmm rod | 19 mm rod | 16 mm rod | static load ($10^3$ KN) |
|---|---|---|---|---|---|---|---|---|---|---|---|---|---|---|---|
| 62 | D | 32 | 901 | 3 | 25 | 0.27 | 2.15 | 38.07 | 0.08 | 299693 | 0 | 0 | 0 | 901 | 19 |
| 62 | D | 32 | 901 | 2.4 | 31 | 0.26 | 2.15 | 39.08 | 0.05 | 307328 | 0 | 0 | 0 | 901 | 19 |
| 62 | D | 32 | 901 | 1.8 | 43 | 0.26 | 2.15 | 40.85 | 0.05 | 320710 | 0 | 0 | 0 | 901 | 19 |
| 62 | D | 32 | 931 | 3 | 17 | 0.39 | 2.15 | 19.63 | 0.11 | 160666 | 0 | 0 | 0 | 931 | 20 |
| 62 | D | 32 | 931 | 2.4 | 21 | 0.39 | 2.15 | 20.11 | 0.11 | 164295 | 0 | 0 | 0 | 931 | 20 |
| 62 | D | 32 | 931 | 1.8 | 29 | 0.38 | 2.15 | 20.97 | 0.1 | 170796 | 0 | 0 | 0 | 931 | 20 |
| 62 | D | 32 | 961 | 3 | 13 | 0.49 | 2.15 | 14.09 | 0.15 | 119163 | 0 | 0 | 0 | 961 | 20 |
| 62 | D | 32 | 961 | 2.4 | 17 | 0.48 | 2.15 | 14.41 | 0.15 | 121582 | 0 | 0 | 0 | 961 | 20 |
| 62 | D | 32 | 961 | 1.8 | 23 | 0.47 | 2.15 | 14.99 | 0.14 | 125967 | 0 | 0 | 0 | 961 | 20 |
| 62 | D | 32 | 991 | 3 | 12 | 0.57 | 2.15 | 11.51 | 0.19 | 100037 | 0 | 0 | 0 | 991 | 20 |
| 62 | D | 32 | 991 | 2.4 | 15 | 0.66 | 2.15 | 11.77 | 0.18 | 102003 | 0 | 0 | 0 | 991 | 20 |
| 62 | D | 32 | 991 | 1.8 | 20 | 0.54 | 2.15 | 12.22 | 0.18 | 105405 | 0 | 0 | 0 | 991 | 20 |
| 62 | D | 32 | 1021 | 3 | 11 | 0.63 | 2.15 | 10.04 | 0.21 | 89303 | 0 | 0 | 0 | 1021 | 20 |
| 62 | D | 32 | 1021 | 2.4 | 13 | 0.62 | 2.15 | 10.26 | 0.21 | 90966 | 0 | 0 | 0 | 1021 | 20 |
| 62 | D | 32 | 1021 | 1.8 | 18 | 0.6 | 2.15 | 10.64 | 0.2 | 93839 | 0 | 0 | 0 | 1021 | 20 |
| 62 | D | 32 | 1051 | 3 | 9.7 | 0.67 | 2.15 | 9.09 | 0.24 | 82500 | 0 | 0 | 0 | 1051 | 20 |
| 62 | D | 32 | 1051 | 2.4 | 12 | 0.66 | 2.15 | 9.28 | 0.23 | 83937 | 0 | 0 | 0 | 1051 | 20 |
| 62 | D | 32 | 1051 | 1.8 | 17 | 0.64 | 2.15 | 9.62 | 0.22 | 86507 | 0 | 0 | 0 | 1051 | 20 |
| 62 | D | 32 | 1081 | 3 | 9.2 | 0.71 | 2.15 | 8.42 | 0.26 | 77814 | 0 | 0 | 0 | 1081 | 23 |
| 62 | D | 32 | 1081 | 2.4 | 12 | 0.7 | 2.15 | 8.8 | 0.25 | 79175 | 0 | 0 | 0 | 1081 | 23 |
| 62 | D | 32 | 1081 | 1.8 | 16 | 0.68 | 2.15 | 8.01 | 0.24 | 81519 | 0 | 0 | 0 | 1081 | 23 |
| 62 | D | 32 | 1111 | 3 | 8.8 | 0.75 | 2.15 | 7.92 | 0.27 | 74414 | 0 | 0 | 0 | 1111 | 24 |
| 62 | D | 32 | 1111 | 2.4 | 11 | 0.74 | 2.15 | 8.08 | 0.27 | 75623 | 0 | 0 | 0 | 1111 | 24 |
| 62 | D | 32 | 1111 | 1.8 | 15 | 0.71 | 2.15 | 8.37 | 0.26 | 77816 | 0 | 0 | 0 | 1111 | 24 |
| 62 | D | 32 | 1141 | 3 | 8.4 | 0.76 | 2.15 | 7.51 | 0.29 | 71693 | 0 | 0 | 0 | 1141 | 24 |
| 62 | D | 32 | 1141 | 2.4 | 11 | 0.76 | 2.15 | 7.67 | 0.28 | 72903 | 0 | 0 | 0 | 1141 | 24 |
| 62 | D | 32 | 1141 | 1.8 | 15 | 0.74 | 2.15 | 7.95 | 0.27 | 75020 | 0 | 0 | 0 | 1141 | 24 |
| 62 | D | 32 | 1171 | 3 | 8.2 | 0.8 | 2.15 | 7.18 | 0.3 | 69578 | 0 | 0 | 0 | 1171 | 24 |
| 62 | D | 32 | 1171 | 2.4 | 10 | 0.79 | 2.15 | 7.33 | 0.29 | 70712 | 0 | 0 | 0 | 1171 | 24 |
| 62 | D | 32 | 1171 | 1.8 | 14 | 0.78 | 2.15 | 7.6 | 0.28 | 72753 | 0 | 0 | 0 | 1171 | 24 |
| 62 | D | 32 | 1201 | 3 | 8.2 | 0.82 | 2.15 | 6.9 | 0.31 | 67840 | 0 | 0 | 0 | 1201 | 24 |
| 62 | D | 32 | 1201 | 2.4 | 10 | 0.81 | 2.15 | 7.04 | 0.3 | 68899 | 0 | 0 | 0 | 1201 | 24 |
| 62 | D | 32 | 1201 | 1.8 | 14 | 0.78 | 2.15 | 7.3 | 0.29 | 70864 | 0 | 0 | 0 | 1201 | 24 |
| 62 | D | 32 | 1231 | 3 | 7.8 | 0.84 | 2.15 | 6.65 | 0.32 | 66330 | 0 | 0 | 0 | 1231 | 24 |
| 62 | D | 32 | 1231 | 2.4 | 9.9 | 0.83 | 2.15 | 6.79 | 0.32 | 67388 | 0 | 0 | 0 | 1231 | 24 |
| 62 | D | 32 | 1231 | 1.8 | 14 | 0.8 | 2.15 | 7.05 | 0.3 | 69354 | 0 | 0 | 0 | 1231 | 24 |
| 62 | D | 32 | 1261 | 3 | 7.7 | 0.86 | 2.15 | 6.43 | 0.33 | 65046 | 0 | 0 | 0 | 1261 | 24 |
| Based on above rule it is arranged as, but the contents is omitted from. | | | | | | | | | | | | | | | |
| 62 | D | 38 | 901 | 3 | 18 | 0.26 | 2.15 | 22.06 | 0.1 | 178657 | 0 | 0 | 0 | 901 | 21 |
| 62 | D | 38 | 901 | 2.4 | 23 | 0.26 | 2.15 | 22.84 | 0.09 | 184554 | 0 | 0 | 0 | 901 | 21 |
| 62 | D | 38 | 901 | 1.8 | 32 | 0.25 | 2.15 | 24.26 | 0.09 | 195289 | 0 | 0 | 0 | 901 | 21 |
| 62 | D | 38 | 931 | 3 | 12 | 0.38 | 2.15 | 12.24 | 0.18 | 104797 | 0 | 0 | 0 | 931 | 22 |
| 62 | D | 38 | 931 | 2.4 | 16 | 0.38 | 2.15 | 12.62 | 0.17 | 107670 | 0 | 0 | 0 | 931 | 22 |
| 62 | D | 38 | 931 | 1.8 | 21 | 0.36 | 2.15 | 13.31 | 0.16 | 112887 | 0 | 0 | 0 | 931 | 22 |
| Based on above rule it is arranged as, but the contents is omitted from. | | | | | | | | | | | | | | | |
| 62 | D | 38 | 1051 | 1.8 | 13 | 0.61 | 2.15 | 6.99 | 0.31 | 65624 | 0 | 0 | 0 | 1051 | 25 |
| 62 | D | 38 | 1081 | 3 | 6.7 | 0.69 | 2.15 | 6.17 | 0.35 | 60804 | 0 | 0 | 0 | 1051 | 26 |
| 62 | D | 38 | 1081 | 2.4 | 8.6 | 0.68 | 2.15 | 6.31 | 0.34 | 61863 | 0 | 0 | 0 | 1051 | 26 |
| Based on above rule it is arranged as, but the contents is omitted from, following list is selected. | | | | | | | | | | | | | | | |
| 62 | D | 44 | 1321 | 3 | 4.2 | 0.84 | 2.15 | 4.25 | 0.51 | 49539 | 0 | 0 | 0 | 1321 | 40 |
| 62 | D | 56 | 1321 | 3 | 2.6 | 0.82 | 2.15 | 3.8 | 0.57 | 46686 | 396 | 462 | 462 | 0 | 64 |
| 62 | E | 44 | 1321 | 3 | 4.3 | 0.82 | 2.15 | 4 | 0.54 | 48414 | 0 | 0 | 0 | 1321 | 36 |
| 62 | E | 56 | 1321 | 3 | 3 | 0.73 | 2.15 | 3.46 | 0.62 | 44331 | 0 | 0 | 0 | 1321 | 46 |
| Based on above rule it is arranged as, pump diameter to 83, pump setting to 1501, others omitted. | | | | | | | | | | | | | | | |

TABLE 2

(1) Static parameter: oil layer middle depth (m): 2339.9, reservoir temperature: 87.8° C., wax precipitation temperature: 41.0° C., crude oil solidifying point: 36° C., gas oil ratio: 12.5 $m^3/m^3$, crude oil density: 0.87 $g/cm^3$, crude saturation pressure: 3.41 Mpa, solution coefficient: 3.68 $m^3/m^3$.Mpa, formation crude viscosity: 10.0 cp, 50° C. degasified crude oil viscosity: 38.9 cp.
(2) Dynamic parameters: daily liquid producing capacity: 41.5 t/d, dynamic fluid level: 290.0 m, water content ratio: 1.32%, oil pressure: 1.27 Mpa, casinghead pressure: 0, inside diameter of casing pipe: 127, kick off point: 318.4 m borehole deviation data:

| Design criteria | Gas oil ratio | Daily liquid production (t/d) | Dynamic fluid level (m) | Submergence depth (m) | Pump Setting (m) | Pump Diameter (mm) | Tube Diameter (mm) | Rod String (inch × m) |
|---|---|---|---|---|---|---|---|---|
| API | 12.5 | 41.5 | 290 | 30.5 | 320.5 | θ44 | 62 | ⅝ × 320.5 |
| | Since current API standard has eliminated the principle of defining submergence depth, no comparison can be made. | | | | | | | |
| Principle of oil production technology | 12.5 | 41.5 | 290 | 50 | 340 | θ44 | 62 | ⅝ × 340 |
| | 12.5 | 41.5 | 290 | 200 | 490 | θ44 | 62 | ⅝ × 490 |
| GLZD | 12.5 | 41.5 | 290 | 404.7 | 694.7 | θ83 | 76 | ⅞ × 694.7 |

| Design criteria | Stroke × Pumping Speed (m/s) | Input Power (kW) | Pump efficiency | System efficiency | Annual Oil Production cost |
|---|---|---|---|---|---|
| API | 3 × 20 | 38.36 | 0.37 | 5% | 294538 yuan |
| | Since current API standard has eliminated the principle of defining submergence depth, no comparison can be made. | | | | |
| Principle of oil production technology | 3 × 16 | 25.57 | 0.48 | 8% | 198098 yuan |
| | 3 × 9 | 12.49 | 0.83 | 17% | 101110 yuan |
| GLZD | 2.4 × 3 | 3.40 | 0.93 | 61% | 38779 yuan |

TABLE 3

| order | Test date | Daily liquid production | Dynamic fluid level (m) | Pump Setting (m) | Pump Diameter (mm) | Stroke × Pumping Speed (m/s) | Type of calculation | Input Power (kW) | Active Power (kW) | Pump efficiency | System efficiency | Relative error |
|---|---|---|---|---|---|---|---|---|---|---|---|---|
| A B | Aug. 4 1998 | 47.5 t/d | 295 | 1507 | θ44 | 3 × 9 | measured | 16.13 | 1.98 | 0.922 | 12.2% | 9.3% |
| | | 47.5 t/d | 295 | 1507 | θ44 | 3 × 9 | theoretic | 17.79 | 1.98 | 0.967 | 11.1% | |
| C | Dec. 6 1999 | 41.5 t/d | 290 | 900.9 | θ56 | 2.4 × 6 | measured | 7.10 | 2.087 | 0.932 | 29.1% | 8.6% |
| | | 41.5 t/d | 290 | 900.9 | θ56 | 2.4 × 6 | theoretic | 6.54 | 2.087 | 0.948 | 31.6% | |

Note:
A: The production layer is the same.
B: Before adusting the parameters.
C: After adusting the parameters.

TABLE 4

(1) Static parameters: oil layer middle depth (m): 1504, reservoir temperature: 68° C., wax precipitation temperature: 40° C., crude oil solidifying point: 35° C., gas oil ratio: 19.00 $m^3/m^3$, crude oil density: 0.8600 $g/cm^3$, crude saturation pressure: 3.82 Mpa, solution coefficient: 4.245 $m^3/m^3$.Mpa, formation crude viscosity: 9.39 cp, 50° C. degasified crude oil viscosity: 27.70 cp.
(2) Dynamic parameter: daily liquid producing capacity: 19.6 t/d, dynamic fluid level: 871.2 m, water content ratio: 0, oil pressure: 0.8 Mpa, casinghead pressure: 0, inside diameter of casing pipe: , kick off point: , borehole deviation data:

| Design criteria | Gas oil ratio | Daily liquid production (t/d) | Dynamic fluid level (m) | Sub-mergence depth (m) | Pump Setting (m) | Pump Dia-meter (mm) | Rod String (inch × m) | Stroke × Pumping Speed (m/s) | Input Power (kW) | Pump efficiency | System efficiency | Annual Oil Prodution cost |
|---|---|---|---|---|---|---|---|---|---|---|---|---|
| API | 19 | 19.6 | 871.2 | 30 | 901 | θ38 | ⅝ × 901 | 3 × 17.9 | 22.06 | 0.26 | 10% | 178657 yuan |
| | Since current API standard has eliminated the principle of defining submergence depth, no comparison can be made. | | | | | | | | | | | |
| Principle | 19 | 19.6 | 871.2 | 50 | 921 | θ32 | ⅝ × 921 | 3 × 18.4 | 23.18 | 0.36 | 9% | 187377 yuan |
| of oil | 19 | 19.6 | 871.2 | 200 | 1071 | θ32 | ⅝ × 1071 | 3 × 9.4 | 8.62 | 0.70 | 25% | 79200 yuan |

TABLE 4-continued (1) Static parameters: oil layer middle depth (m): 1504, reservoir temperature: 68° C., wax precipitation temperature: 40° C., crude oil solidifying point: 35° C., gas oil ratio: 19.00 $m^3/m^3$, crude oil density: 0.8600 $g/cm^3$, crude saturation pressure: 3.82 Mpa, solution coefficient: 4.245 $m^3/m^3$.Mpa, formation crude viscosity: 9.39 cp, 50° C. degasified crude oil viscosity: 27.70 cp.
(2) Dynamic parameter: daily liquid producing capacity: 19.6 t/d, dynamic fluid level: 871.2 m, water content ratio: 0, oil pressure: 0.8 Mpa, casinghead pressure: 0, inside diameter of casing pipe: , kick off point: , borehole deviation data:

| Design criteria | Gas oil ratio | Daily liquid production (t/d) | Dynamic fluid level (m) | Sub-mergence depth (m) | Pump Setting (m) | Pump Dia-meter (mm) | Rod String (inch × m) | Stroke × Pumping Speed (m/s) | Input Power (kW) | Pump efficiency | System efficiency | Annual Oil Prodution cost |
|---|---|---|---|---|---|---|---|---|---|---|---|---|
| production technology GLZD | 19 | 19.6 | 871.2 | 453 | 1324 | θ56 | ⅝ × 1324 (E grade) | 3 × 2.6 | 3.45 | 0.73 | 62% | 44390 yuan |

TABLE 5

| Order | Test date | Daily liquid production | Dynamic fluid level (m) | Pump Setting (m) | Pump Diameter (mm) | Stroke × Pumping Speed (m/s) | Type of calculation | Input Power (kW) | Active power (kW) | Pump efficiency | System efficiency | Relative error |
|---|---|---|---|---|---|---|---|---|---|---|---|---|
| Before changing the layer | Jan. 17 1997 | 15.1 t/d | 890.9 | 1208 | θ38 | 6 × 2.4 | measured | 4.860 | 1.688 | 0.747 | 0.347 | 7.7% |
| | | 15.1 t/d | 890.9 | 1208 | θ38 | 6 × 2.4 | theoretic | 4.494 | 1.688 | 0.775 | 0.376 | |
| After changing the layer | Jan. 4 1997 | 19.2 t/d | 874.2 | 1350 | θ44 | 5 × 2.4 | measured | 4.150 | 2.192 | 0.811 | 0.528 | 5.8% |
| | | 19.2 t/d | 871.2 | 1350 | θ44 | 5 × 2.4 | theoretic | 4.389 | 2.192 | 0.802 | 0.499 | |

TABLE 6

(1) Static parameters: oil layer middle depth (m): 1503.6, reservoir temperature: 68° C., wax precipitation temperature: 40° C., crude oil solidifying point: 35° C., gas oil ratio: 19.00 $m^3/m^3$, crude oil density: 0.8600 $g/cm^3$, crude saturation pressure: 3.82 Mpa, solution coefficient: 4.24 $m^3/m^3$.Mpa, formation crude viscosity: 9.39 cp, 50° C. degasified crude oil viscosity: 27.70 cp.
(2) Dynamic parameters: daily liquid producing capacity: 19.2 t/d, dynamic fluid level: 905.9 m, water content ratio: 0, oil pressure: 0.65 Mpa, casinghead pressure: 0, inside diameter of casing pipe: 12, kick off point: 450 m, borehole deviation data:

| Design criteria | Gas oil ratio | Daily liquid Production (t/d) | Dynamic fluid level (m) | Sub-mergence Depth (m) | Pump Setting (m) | Pump Dia-meter (mm) | Rod String (inch × m) | Stroke × Pumping Speed (m/s) | Input Power (kW) | Pump efficiency | System efficiency | Annual Oil Prodution cost |
|---|---|---|---|---|---|---|---|---|---|---|---|---|
| API | 19 | 19.2 | 905.9 | 30 | 936 | θ38 | ⅝ × 936 | 3 × 17.6 | 21.61 | 0.26 | 10% | 175694 yuan |
| Since current API standard has eliminated the principle of defining submergence depth, no comparison can be made. | | | | | | | | | | | | |
| Principle of oil production technology | 19 | 19.2 | 905.9 | 50 | 956 | θ32 | ⅝ × 956 | 3 × 18.1 | 22.65 | 0.35 | 9% | 183809 yuan |
| | 19 | 19.2 | 905.9 | 200 | 1106 | θ32 | ⅝ × 1106 | 3 × 9.2 | 8.44 | 0.70 | 25% | 78278 yuan |
| GLZD | 19 | 19.2 | 905.9 | 453 | 1349 | θ56 | ⅝ × 1349 (E grade) | 3 × 2.9 | 3.41 | 0.71 | 63% | 44284 yuan |

TABLE 7

| Order | Test date | Daily liquid Production | Dynamic fluid level (m) | Pump Setting (m) | Pump Diameter (mm) | Stroke × Pumping Speed (m/s) | Type of calculation | Input Power (kW) | Active power (kW) | Pump efficiency | System efficiency | Relative error |
|---|---|---|---|---|---|---|---|---|---|---|---|---|
| A B | Jun. 27 1997 | 19.20 t/d | 905.90 | 1238 | θ38 | 2.35 × 8.46 | measured | 6.126 | 2.141 | 0.688 | 0.349 | 2.2% |
| | | 19.20 t/d | 905.90 | 1238 | θ38 | 2.35 × 8.46 | theoretic | 6.265 | 2.141 | 0.781 | 0.342 | |
| C | Aug. 30 1997 | 19.20 t/d | 969.0 | 1238 | θ44 | 2.32 × 6.31 | measured | 4.53 | 2.266 | 0.693 | 0.5 | 10.1% |
| | | 19.20 t/d | 969.0 | 1238 | θ44 | 2.32 × 6.31 | theoretic | 5.037 | 2.266 | 0.589 | 0.45 | |

Note:
A: The production layer is the same.
B: Before adusting the parameters
C: After adusting the parameters

What is claimed is:

1. A method of mechanical oil production with a sucker-rod pump, comprising:

(a) predicting the objective daily liquid production, water cut, and dynamic fluid level of an oil well;

(b) measuring degasified crude oil viscosity on the ground and wax precipitation temperature of crude oil;

(c) acquiring physical parameters of formation crude oil in the oil well;

(d) measuring oil middle layer temperature and earth surface temperature;

(e) selecting the type of a beam pumping unit;

(f) preliminary determining the ranges of oil tube diameters, oil tube length, diameters of the deep well pump, pump setting depth of the deep well pump, material type of the sucker-rod, rod string, and strokes and pumping speeds of the beam pumping unit;

(g) finding out all combinations of different pump diameters, pump setting depths, tube diameters, rod material types, rod strings, strokes, and pumping speeds, which can achieve the same daily liquid production, then calculating out input power $P_{input}$ respectively corresponding to each parameter combination according to following formula:

$$P_{input}=P_{active}-P_{expansion}+\Sigma P_{loss}$$

where:

$P_{active}$ is active power (W);

$P_{expansion}$ is expansion power (W) caused by crude oil degasifying in oil tube above the pump standing valve;

$P_{loss}$ is total loss power;

(h) taking the combination of parameters corresponding to minimum $P_{input}$ as the system parameters of mechanical oil production, or taking the one corresponding to minimum cost of mechanical oil production as the parameters of the machinery system of oil production;

(i) deciding oil tube specification and length based on tube diameter and pump depth, deciding the specification of the deep well pump by pump diameter and stroke, and deciding specification and length of required each type of the sucker-rod by material type and structure of the sucker-rod;

(j) deciding the type of the motor based on input power and pumping speed so that the oil production system can be established by the specific beam pumping unit, the motor, the oil tubes, the sucker-rods as well as the deep well pump.

2. The method of mechanical oil production with a sucker-rod pump according to claim 1, characterized in that said physical parameters of formation crude oil in an oil well include gas oil ratio, saturation pressure, solution coefficient, formation crude oil viscosity, and formation crude oil density.

3. The method of mechanical oil production with a sucker-rod pump according to claim 1, characterized in that the pump setting depth is sequenced: when fluid pressure is larger than or equal to saturation pressure, the pump setting begins from dynamic fluid level, then base on interval step length sequencing depth is in turn deepened until pump intake pressure is equal to saturation pressure; when fluid pressure is lower than saturation pressure, the pump setting begins from dynamic fluid level, then base on interval step length sequencing depth is in turn deepened until to top of an oil layer.

4. The method of mechanical oil production with a sucker-rod pump according to claim 1, characterized in that said total loss power $\Sigma P_{loss}$ is decided on the basis of follows:

$$\Sigma P_{loss}=P_u+P_r+P_k$$

where:

$P_u$ is loss powers of the ground beam pumping unit and the motor(W);

$P_r$ is viscous loss powers caused by friction occurred between oil tube liquid positioned above the pump cylinder and the oil tube, the sucker-rod (W);

$P_k$ is sliding loss powers caused by friction occurred between the sucker-rod and the oil tube and caused by friction occurred between the piston and the pump cylinder during the sucker-rod is reciprocated.

5. The method of mechanical oil production with a sucker-rod pump according to claim 1, characterized in that the steps of determining said expansion power $P_{expansion}$ are as follows:

A: when $P_{sub} \geqq P_b$ and $P_{wellhead} < P_b$ $$P_{expansion} = \frac{10^5 \alpha Q_{oil} P_b}{86400} \ln \frac{10P_b + 1}{10P_{wellhead} + 1}$$

B: when $P_{sub} \geqq P_b$ and $P_{wellhead} \geqq P_b$ $P_{expansion}=0$

C: when $P_{sub} < P_b$ and $P_{sub} > P_{wellhead}$ $$P_{expansion} = \frac{10^5 \alpha Q_{oil} P_{sub}}{86400} \ln \frac{10P_{sub} + 1}{10P_{wellhead} + 1}$$

D: when $P_{sub} < P_b$ and $P_{wellhead} > P_{sub}$ $P_{expansion}=0$ $$Q_{oil}=QF_w$$

where:

$P_{expansion}$: expansion power (W)

$P_{sub}$: pump intake pressure (Mpa)

$P_b$: crude oil saturation pressure (Mpa)

$P_{wellhead}$: wellhead oil pressure (Mpa)

$\alpha$: solution coefficient ($m^3/m^3$Mpa)

$Q_{oil}$: daily crude oil output ($m^3/d$)

Q: daily liquid producing capacity $F_w$: water content.

6. The method of mechanical oil production with a sucker-rod pump according to claim 4, characterized in that said ground loss power $P_u$ is decided by following equation:

$$P_u=P_d+k_1(F_{up}+F_{down})\cdot s\cdot n+k_2(F_{up}-F_{down})\cdot s\cdot n$$

where:

$$S\cdot N=4Q/(\pi D_{pump}^2\eta)$$

$P_d$: motor power (w) without load $F_{up}$: average load of polished rod in up stroke (N)

$F_{down}$: average load of polished rod in down stroke (N)

$k_1$: influence coefficient of polished rod transmission power on $P_u$ $k_2$: influence coefficient of polished rod power on $P_u$ s: stroke (m/time)

n: pumping speed (times/s)

Q: daily liquid production ($m^3/s$)

$\eta$: pump efficiency.

7. The method of mechanical oil production with a sucker-rod pump according to claim 4, characterized in that the sliding loss power $P_k$ is decided by following equation:

$$P_k=2f_k \cdot q_{rod} \cdot L_{level} \cdot s \cdot n$$

where:

$f_k$: sliding friction coefficient between the rod and the tube, $$f_k=0.05\sim0.18$$

$q_{rod}$: average unit length weight of the rod in inclination section (N/M)

$L_{level}$: horizontal projection track length of the rod of inclination section (m).

8. The method of mechanical oil production with a sucker-rod pump according to claim 4, characterized in that said viscous loss power $P_r$ is decided according to following equation:

$$P_r=k_3\pi^3 s^2 n^2\{(m^2-1)/[(m^2+1)\ln m-(m^2-1)]\}\Sigma\mu_i L_i$$

$$\Sigma\mu_i L_i=k_4\mu_o(T_{layer}-T_{wax})+k_5\mu_o Q_{oil}(T_{wax}-T_{wellhead})+k_6\mu_o(-f_w^2+1.2f_w)+C$$

$$T_{wellhead}=k_7 Q_1(T_{layer}-T_{ground})+k_2 Q_1 H_{dyn}+k_3 P_{expansion}+C_2$$

$$Q_1=Q+(C_w/C_o-1)QF_w$$

where:

$T_{wellhead}$: wellhead oil temperature in crude oil lifting process (°C.)

$T_{layer}$: reservoir temperature (°C.)

$T_{wax}$: crude oil wax precipitation temperature (°C.)

$Q_{oil}$: oil well daily crude oil output ($m^3$/d)

$\mu_o$: degasified crude oil viscosity (mpa. s)

$\mu_i$: crude oil viscosity at ith segment of the oil tube in crude oil lifting process (mpa. s)

$L_i$: ith segment oil tube length m: oil tube inside diameter and sucker-rod diameter ratio $k_3$: sucker-rod collar coefficient $k_4$,$k_5$,$k_6$: measured coefficient C, $C_2$: measured constant $C_w$: water specific heat (J/Kg)

$C_o$: oil specific heat (J/Kg).

9. The method of mechanical oil production with a sucker-rod pump according to claim 4, characterized in that the total loss power $\Sigma P_{loss}$ is decide base on following equation:

$$\Sigma P_{loss}=P_d+[(F_{up}+F_{down})k_1+(F_{up}-F_{down})k_2]sn+k_3\pi^3 s^2 n^2\{(m^2-1)/[(m^2+1)\ln m-(m^2-1)]\}*\Sigma\mu_i L_i+2f_k q_{rod} L_{level} sn.$$

10. The method of mechanical oil production with a sucker-rod pump according to claim 4, characterized in that the total loss power $\Sigma P_{loss}$ also can be determined base on following equation:

$$\Sigma P_{loss}=P_d+[(F_{up}+F_{down})k_1+(F_{up}-F_{down})k_2]$$

$$4Q/\pi\rho D_{pump}^2\eta 86400$$

$$+k_3 24\pi\{(m^2-1)/[(m^2+1)\ln m-(m^2-1)]\}*\Sigma(\mu_i$$

$$L_i)*Q^2/\rho^2 D_{pump}^4\eta^2 86400^2$$

$$+8f_k q_{rod} L_{level} Q/\pi\rho D_{pump}^2\eta 86400$$

where:

$D_{pump}$: deep well pump plunger diameter (mm)

η: pump efficiency.

11. A system of mechanical oil production with a sucker-rod pump, including a beam pumping unit, a motor, tubes, rod string and a deep well pump; said motor being fitted on the beam pumping unit and driving the latter, the sucker-rod being positioned in said oil pumping tube, said beam pumping unit being connected with the sucker-rod by a jointer, and the sucker-rod being conjoined with the plunger of the pump submerged under the liquid level, the operating cylinder of the pump being connected with said oil tube; wherein structure parameters of individual components in the system are selected as follows: (a) selecting the type of the beam unit based on objective daily liquid production, water cut, and dynamic fluid level of the oil well; (b) preliminary determining the ranges of tube diameters, tube length, diameters of the deep well pump, pump setting depth of the deep well pump, material types of the sucker-rod, rod string, length of each rod, strokes and pumping speeds of the beam pumping unit in the machinery system of oil production; (c) finding out all combinations of different pump diameters, pump depths, tube diameters, rod material types, rod strings, strokes, and pumping speeds, then calculating out input power $P_{input}$ respectively corresponding to each parameter combination according to the formula listed below:

$$P_{input}=P_{active}-P_{expansion}+\Sigma P_{loss}$$

where:

$P_{active}$ is active power (W);

$P_{expansion}$ is expansion power (W) caused by crude oil degasifying in oil tube above the pump standing valve;

$\Sigma P_{loss}$ is total loss power (d) taking the parameter combination corresponding to minimum $P_{input}$ as the system parameters of mechanical oil production, or taking the one corresponding to minimum cost of mechanical oil production as the system parameters of mechanical oil production;

(e) deciding oil tube material type and length based on tube diameter and pump depth; (f) deciding the type of the motor coupled with the beam unit by defined pumping speed and system input power so that the machinery system of oil production can be established by the special beam unit, the motor, the oil tubes, the sucker-rods, and the pump.

12. The system of mechanical oil production with a sucker-rod pump according to claim 11, characterized in that the steps of determining said total loss power $\Sigma P_{loss}$ are as follows:

$$\Sigma P_{loss}=P_u+P_r+P_k$$

where:

$P_u$ is loss powers of the ground beam unit and the motor(W);

$P_r$ is viscous loss powers caused by friction occurred between oil tube liquid positioned above the pump cylinder and the oil tube , the sucker-rod (W);

$P_k$ is sliding loss powers caused by friction occurred between the sucker-rod and the oil tube and caused by friction occurred between the piston and the pump cylinder during the sucker-rod is reciprocated.

13. The system of mechanical oil production with a sucker-rod pump according to claim 11, characterized in that the steps of determining the said expansion power $P_{expansion}$ are as follows:

A: when $P_{sub} \geqq P_b$ and $P_{wellhead} < P_b$ $$P_{expansion} = \frac{10^5 \alpha Q_{oil} P_b}{86400} \ln \frac{10P_b + 1}{10P_{wellhead} + 1}$$

B: when $P_{sub} \geqq P_b$ and $P_{wellhead} \geqq P_b$ $P_{expansion}=0$

C: when $P_{sub} < P_b$ and $P_{sub} > P_{wellhead}$ $$P_{expansion} = \frac{10^5 \alpha Q_{oil} P_{sub}}{86400} \ln \frac{10P_{sub} + 1}{10P_{wellhead} + 1}$$

D: when $P_{sub} < P_b$ and $P_{wellhead} > P_{sub}$ $P_{expansion}=0$ where:

$P_{expansion}$: expansion power (W)

$P_{sub}$: pump intake pressures (Mpa)

$P_b$: crude oil saturation pressure (Mpa)

$P_{wellhead}$: wellhead oil pressure (Mpa)

$\alpha$: solution coefficient ($m^3/m^3$ Mpa)

$Q_{oil}$: daily crude oil production ($m^3$/d).

14. The system of mechanical oil production with a sucker-rod pump according to claim 12, characterized in that the ground loss power of $P_u$ is decided by following equation:

$$P_u = {}_d + k_1(F_{up} + F_{down}) \cdot s \cdot n + k_2(F_{up} - F_{down}) \cdot s \cdot n$$

where $P_d$: motor power (w) without load $F_{up}$: average load of polished rod in up stroke (N)

$F_{down}$: average load of polished rod in down stroke (N)

$k_1$: influence coefficient of polished rod transmission power on $P_u$ $k_2$: influence coefficient of polished rod power on $P_u$ s: stroke (m/time)

n: pumping speed (times/s).

15. The system of mechanical oil production with a sucker-rod pump according to claim 12, characterized in that the sliding loss power $P_k$ is calculated by following equation:

$$P_k = 2f_k \cdot q_{rod} \cdot L_{level} \cdot s \cdot n$$

where:

$f_k$: sliding friction coefficient between rod and tube, $$f_k = 0.05 \sim 0.18$$

$q_{rod}$: average unit length weight of the rod in inclination section (N/M)

$L_{level}$: horizontal projection track length of the rod of inclination section (m).

16. The system of mechanical oil production with a sucker-rod pump according to claim 12, characterized in that the said viscous loss power $P_r$ is decided according to following equation:

$$P_r = k_3 \pi^3 s^2 n^2 \{(m^2-1)/[(m^2+1)\ln m - (m^2-1)]\} \Sigma \mu_i L_i$$

$$\Sigma \mu_i L_i = k_4 \mu_o (T_{layer} - T_{wax}) + k_5 \mu_o Q_{oil} (T_{wax} - T_{wellhead}) + k_6 \mu_o (-f_w^2 + 1.2 f_w) + C$$

$$T_{wellhead} = k_7 Q_1 (T_{layer} - T_{ground}) + k_2 Q_1 H_p + k_3 P_{expansion} + C_2$$

$$Q_1 = Q + (C_w/C_o - 1) Q F_w$$

where:

$T_{wellhead}$: wellhead oil temperature in crude oil lifting process (°C.)

$T_{layer}$: reservoir temperature (°C.)

$T_{wax}$: crude oil wax precipitation temperature (°C.)

$Q_{oil}$: oil well daily crude oil output ($m^3$/d)

Q: daily liquid production ($m^3$/d)

$\mu_o$: degasified crude oil viscosity (mpa. s)

$\mu_i$: crude oil viscosity at ith segment of the oil tube during crude oil being lifted (mpa. s)

$L_i$: ith segment oil tube length m: oil tube inside diameter and sucker-rod diameter ratio $k_3$: sucker-rod collar coefficient $k_4, k_5, k_6$: measured coefficient C, $C_2$: measured constant $C_w$: water specific heat (J/Kg)

$C_o$: oil specific heat (J/Kg).

17. The system of mechanical oil production with a sucker-rod pump according to claim 12, characterized in that the total loss power $\Sigma P_{loss}$ can be calculated base on following equation:

$$\Sigma P_{loss} = P_d + [(F_{up} + F_{down}) k_1 + (F_{up} - F_{down}) k_2] s n + k_3 \pi^3 s^2 n^2 \{(m^2-1)/[(m^2+1)\ln m - (m^2-1)]\} * \Sigma \mu_i L_i + 2 f_k q_{rod} L_{level} s n.$$

18. The system of mechanical oil production with a sucker-rod pump according to claim 12, characterized in that the said total loss power $\Sigma P_{loss}$ also can be decided base on following equation:

$$\Sigma P_{loss} = P_d + [(F_{up} + F_{down}) k_1 + (F_{up} - F_{down}) k_2]$$

$$4Q/\pi\rho D_{pump}^2 \eta 86400$$

$$+ k_3 24\pi \{(m^2-1)/[(m^2+1)\ln m - (m^2-1)]\} * \Sigma(\mu_i$$

$$L_i) * Q^2/\rho^2 D_{pump}^4 \eta^2 86400^2$$

$$+ 8 f_k q_{rod} L_{level} Q/\pi\rho D_{pump}^2 \eta 86400$$

where:

$D_{pump}$: deep well pump plunger diameter (mm)

$\eta$: pump efficiency.

* * * * *